US010968610B2

(12) United States Patent
Modica

(10) Patent No.: US 10,968,610 B2
(45) Date of Patent: Apr. 6, 2021

(54) FAUCET INSULATION APPARATUS

(71) Applicant: Rose Elizabeth Modica, Shrevport, LA (US)

(72) Inventor: Rose Elizabeth Modica, Shrevport, LA (US)

( * ) Notice: Subject to any disclaimer, the term of this patent is extended or adjusted under 35 U.S.C. 154(b) by 0 days.

(21) Appl. No.: 16/882,345

(22) Filed: May 22, 2020

(65) Prior Publication Data

US 2020/0318324 A1 Oct. 8, 2020

Related U.S. Application Data

(63) Continuation-in-part of application No. 16/000,856, filed on Jun. 5, 2018, now abandoned.

(51) Int. Cl.
*E03B 9/02* (2006.01)

(52) U.S. Cl.
CPC ..... *E03B 9/027* (2013.01); *Y10T 137/698* (2015.04); *Y10T 137/7036* (2015.04)

(58) Field of Classification Search
CPC ..... E03B 9/027; Y10T 137/7036; Y10T 137/698; F16L 59/14; F16L 59/16; F16L 59/161
See application file for complete search history.

(56) References Cited

U.S. PATENT DOCUMENTS 2,650,180 A ‡ 8/1953 Walker ..... F16L 59/024 137/375
2,686,530 A ‡ 8/1954 Dire ..... F16K 27/12 137/37
2,985,552 A ‡ 5/1961 Watanabe ..... F16L 59/161 150/15
4,071,043 A ‡ 1/1978 Carlson ..... F16L 59/161 137/37
4,103,701 A ‡ 8/1978 Jeng ..... E03B 7/12 137/375
4,244,394 A ‡ 1/1981 Hartselle, III ..... F16K 27/12 137/37
4,259,981 A ‡ 4/1981 Busse ..... F16L 59/161 137/375
4,577,655 A ‡ 3/1986 Carroll ..... F16K 49/00 137/37
4,738,998 A ‡ 4/1988 Uffner ..... C09J 195/00 524/69
5,878,776 A ‡ 3/1999 Love ..... F16L 59/161 137/37
6,012,480 A ‡ 1/2000 Helmsderfer ..... F16L 7/00 137/247.49

(Continued)

OTHER PUBLICATIONS

The Faucet Beanie, gonext.fatcow.com/faucetbeanie/8601.html.

*Primary Examiner* — Kevin F Murphy
(74) *Attorney, Agent, or Firm* — Patrick Mixon

(57) ABSTRACT

The faucet insulator apparatus is a device which enables one to help protect a faucet and by extension connected pipes from cold weather elements. The invention is comprised of an insulation region and a capturing recess which provide a faucet cover for protecting a faucet against inclement weather. The portion of the inner walls of the faucet insulator, which come in contact with the faucet, are configured to deform and grasp the faucet to secure the faucet insulator apparatus to portions of the faucet's surface.

19 Claims, 8 Drawing Sheets

(56) References Cited

U.S. PATENT DOCUMENTS

| | | | | |
|---|---|---|---|---|
| 6,161,568 | A ‡ | 12/2000 | Dragotta | E03C 1/025 137/148 |
| 6,216,722 | B1 ‡ | 4/2001 | Solomon | E03B 7/12 137/297 |
| 8,511,335 | B2 ‡ | 8/2013 | Murphy | F16L 59/161 137/294 |
| 9,261,203 | B2 ‡ | 2/2016 | Vulpitta | F16K 35/10 |
| 2012/0037259 | A1 ‡ | 2/2012 | Shumate | B32B 1/08 138/149 |
| 2015/0267832 | A1 ‡ | 9/2015 | Abernethy, Jr. | F16K 49/00 137/375 |
| 2018/0267831 | A1 ‡ | 9/2018 | Nukariya | G06F 9/5083 |

‡ imported from a related application

FAUCET INSULATION APPARATUS

CROSS REFERENCE TO RELATED APPLICATIONS

This application is a continuation-in-part of, and claims priority to, U.S. patent application Ser. No. 16/000,856, titled "Faucet Insulation Apparatus," filed Jun. 5, 2018, which claims priority to U.S. Provisional Application 62/603,561 filed on Jun. 5, 2017, titled "Faucet Insulator," which are all commonly invented and commonly owned by the present inventor.

FIELD OF THE INVENTION

The disclosure as detailed herein is in the technical field of insulation material. Moreover, this is in the field of insulator covers used external to a dwelling. Moreover, this is in the field of faucet insulator covers, for faucets that are exposed to climate change external to a building or dwelling.

BACKGROUND OF THE INVENTION

Faucets are devices which control the flow of liquid or gas from a pipe or container. Typically, faucets control the flow of the liquid in one direction. A faucet may conventionally be connected to the pipe or container for receiving a liquid or gas therefrom.

FIG. 7 depicts an exemplary embodiment of a prior art faucet 700, which may be used with the present invention. Faucet 700 may include a conduit 704 through which any liquid may pass. A faucet 700 for which the invention is used is one which is connected to a plumbing system or pipe. Conduit 704 may include a first open end 702 for receiving the liquid, and a second open end 706 ("spout 706") for permitting liquid entering first open end 702, to pass through conduit 704 and exit at spout 706.

Faucet 700 will include a mechanism for controlling the flow of the liquid through conduit 704. For example, faucet 700 may include a liquid flow control valve 708 for determining the volume of liquid transported by faucet 700. More particularly, liquid flow control valve 708 controls the volume of liquid exiting spout 706.

In a typical prior art embodiment, liquid flow control valve 708 may include a valve 710 for obstructing the flow of liquid. For example, valve 710 may be a ball valve as is found in the prior art faucets. Liquid flow control valve 708 may include a faucet handle 712, in communication with a stem 714. Stem 714 may be in further communication with valve 710, such that when faucet handle 712 is actuated (i.e., rotated), stem 714 causes valve 710 to facilitate the flow of liquid to spout 706. Not only may the conventional transport mechanism 710 impede the flow of the liquid, liquid flow control valve 708 may be configured to allow the free flow of the liquid.

Unfortunately, when faucets are placed external to a dwelling the faucet is subject to the change in the climate. For example, in tropical climates the faucet may be subjected to moisture or rain, which can cause the faucet to rust and be difficult to open. Alternatively, in colder climates, the faucet may become inoperable because moister freezes either liquid contained in the conduit 704, or in the liquid flow control valve 708, making it impossible for faucet 700 to perform its intended function, namely, to control the flow of a liquid (or gas) from a pipe or container. By "control" what is meant is that faucet 700 regulates the flow (or volume) of liquid passing through faucet 700 (i.e., regulating the volume of liquid flowing through conduit 704).

It is desirable for a faucet to be protected from the changing climate to ensure that the faucet continues to function properly. Current products on the market for protecting (i.e., "shielding") faucets are faucet covers which difficult to use and time consuming to install. These covers are especially difficult to quickly install when the weather conditions change suddenly, such as when winter storms start without warning.

For example, U.S. Pat. No. 5,878,776, titled "Insulating Jacket," issued Mar. 9, 1999 to Love, teaches an insulating jacket for covering and insulating an exterior faucet against cold weather. The insulating jacket teaches using three plastic bags arranged concentrically and all opening in one direction. The invention is a fabric sock that is secured to the faucet using a draw cord. Unfortunately, the invention is deficient in that it uses a draw cord in its construction. A draw cord would require the user to remain in the inclement weather while the user attempts to properly fit the device on the faucet. Therefore, the device is not desirable because it increases the time the user would need to install the device.

Another faucet cover typical of conventional covers is taught by U.S. Pat. No. 9,261,203 (the "'203 Patent"), titled "Inflatable Faucet Insulation" issued Feb. 16, 2016 to Vulpitta. The '203 Patent teaches a faucet cover having several inflatable layers. However, just as with the prior art described above, the invention disclosed in the '203 patent is inconvenient and time consuming to install. The device's air chambers must be inflated before each use.

Yet another shortcoming of prior art faucet covers is that they do not stay affixed to the faucet once installed. The prior art faucet covers merely rest on the faucet, permitting the wind to easily remove them.

What is needed is an apparatus for protecting a faucet that may be installed in seconds compared to existing ones on the market. This would protect pipes without taking away the integrity of the insulator.

This can prevent pipes from being broken and costly damages and repairs. This would be more effective for homeowners in colder geographical climates. Further, this would be ideal for people with physical limitations with their hands. Purchasers would no longer be required to stand in the harsh winter conditions for long periods of time trying to install conventional faucet covers or have to attempt a do-it-yourself solution.

BRIEF SUMMARY OF THE INVENTION

The faucet insulator apparatus of the present invention is a device which enables one to help protect a faucet that is being exposed to the climate. The invention is a significant improvement over other solutions in that it is quick and easy to install. In addition, the faucet insulator apparatus disclosed herein is an improvement over the prior art because faucet insulator apparatus remains in place once installed. The invention is comprised of an insulation region and a capturing recess which provide a form fitting system for a variety of outdoor faucets.

In some embodiments, the faucet insulation apparatus comprises an insulation region, and a capturing recess. In some embodiments, said insulation region is adapted to conform to a faucet. In some embodiments, said insulation region shape is cylindrical.

In some embodiments, said capturing recess is circular shaped. In some embodiments, said insulation region is positioned to surround said capturing recess. In some embodiments, said capturing recess is positioned within said insulation region.

In some embodiments, said capturing recess is positioned surrounding said faucet. In some embodiments, said capturing recess is adapted to surround and grasp said faucet. In some embodiments, said capturing recess has a minimum diameter of 2 inches and a maximum diameter of 4 inches. By grasp what may be meant is that the capturing recess encircles the faucet, and deforms to a portion of the faucets shape. In this instance, grasping does not mean to hold with close engagement. Here, grasping means that the capturing recess encircles the faucet and the insulation region deforms such that the area of the insulation region with comes in contact with the faucet, partially envelopes the faucet in the insulation region.

In some embodiments, said insulation region has a minimum diameter of 4 inches and a maximum diameter of 8 inches. In some embodiments, said insulation region comprises a circular insulation region, a base region, and a top region. In some embodiments, said circular insulation region is adapted to mediate the insulating effects on said faucet.

In some embodiments, said circular insulation region is positioned outside said capturing recess. In some embodiments, said base region is positioned below said circular insulation region. In some embodiments, said base region is positioned below said circular insulation region.

In some embodiments, said circular insulation region has a minimum length of 4 inches and a maximum length of 8 inches. In some embodiments, said circular insulation region has a minimum thickness of 0.5 inches and a maximum thickness of 1.5 inches. In some embodiments, said base region comprises a base, and a base edge. In some embodiments, said base region is positioned below said circular insulation region.

In some embodiments, wherein said insulation region is made of polyurethane. In some embodiments, said insulation region is made of ethelyne-vinyl acetate. In some embodiments, said insulation region is made of rubber. In some embodiments, said insulation region is made of polystyrene. In some embodiments, said insulation region is made of foil insulation. In some embodiments, said insulation region is made of fiberglass.

DETAILED DESCRIPTION

One or more different inventions may be described in the present application. Further, for one or more of the inventions described herein, numerous alternative embodiments may be described; it should be appreciated that these are presented for illustrative purposes only and are not limiting of the inventions contained herein or the claims presented herein in any way.

One or more of the inventions may be widely applicable to numerous embodiments, as may be readily apparent from the disclosure. In general, embodiments are described in sufficient detail to enable those skilled in the art to practice one or more of the inventions, and it should be appreciated that other embodiments may be utilized and other changes may be made without departing from the scope of the particular inventions. Accordingly, one skilled in the art will recognize that one or more of the inventions may be practiced with various modifications and alterations. Particular features of one or more of the inventions described herein may be described with reference to one or more particular embodiments or figures that form a part of the present disclosure, and in which are shown, by way of illustration, specific embodiments of one or more of the inventions. It should be appreciated, however, that such features are not limited to usage in the one or more particular embodiments or figures with reference to which they are described.

The present disclosure is neither a literal description of all embodiments of one or more of the inventions nor a listing of features of one or more of the inventions that must be present in all embodiments.

Headings of sections provided in this patent application and the title of this patent application are for convenience only, and are not to be taken as limiting the disclosure in any way. When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other embodiments of one or more of the inventions need not include the device itself.

Figure 1:
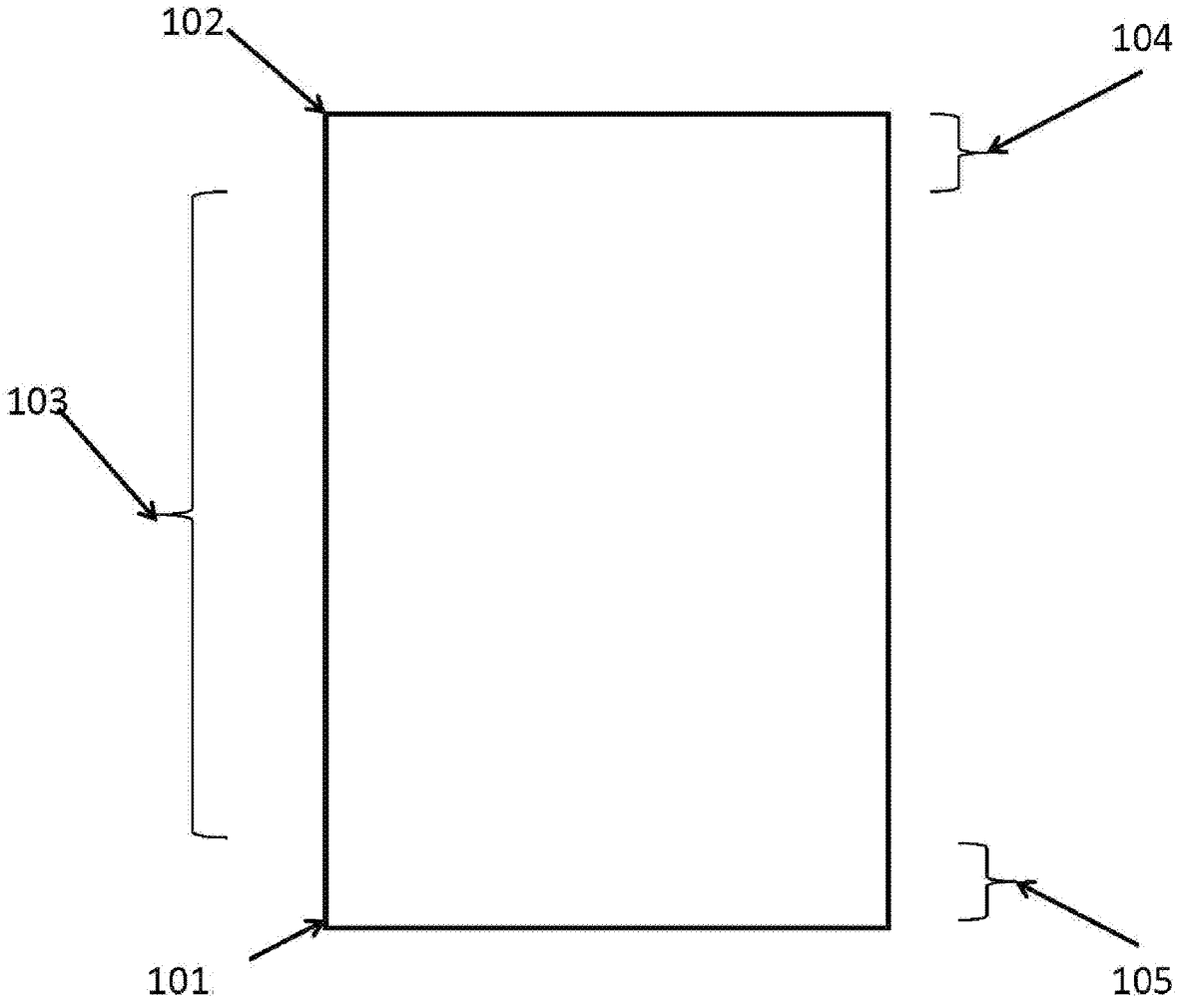
FIG. 1 is a perspective view, which shows the faucet insulator apparatus with the functional regions annotated.
Figure 2:
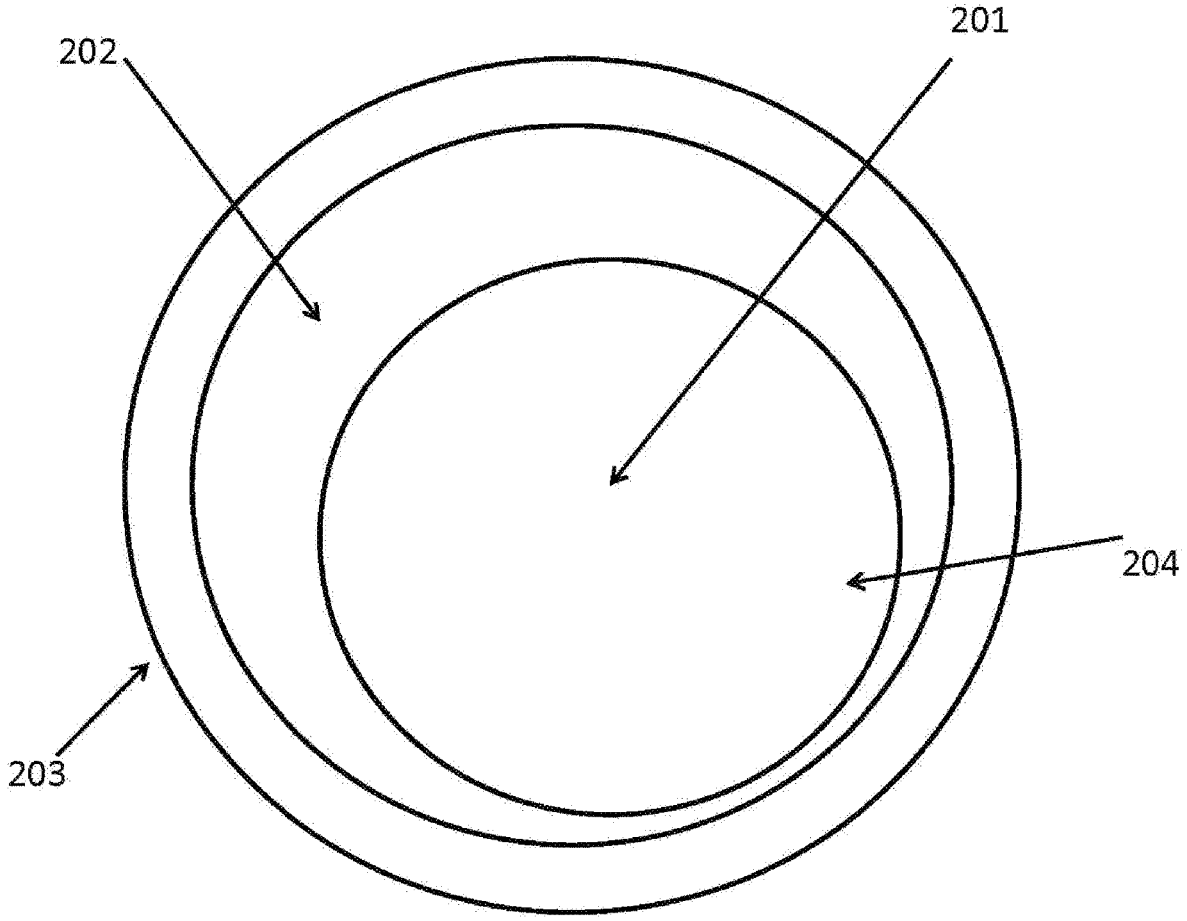
FIG. 2 is a top-down view of the inside of the faucet insulation apparatus showing the capturing recess for receiving the faucet.
Figure 3:
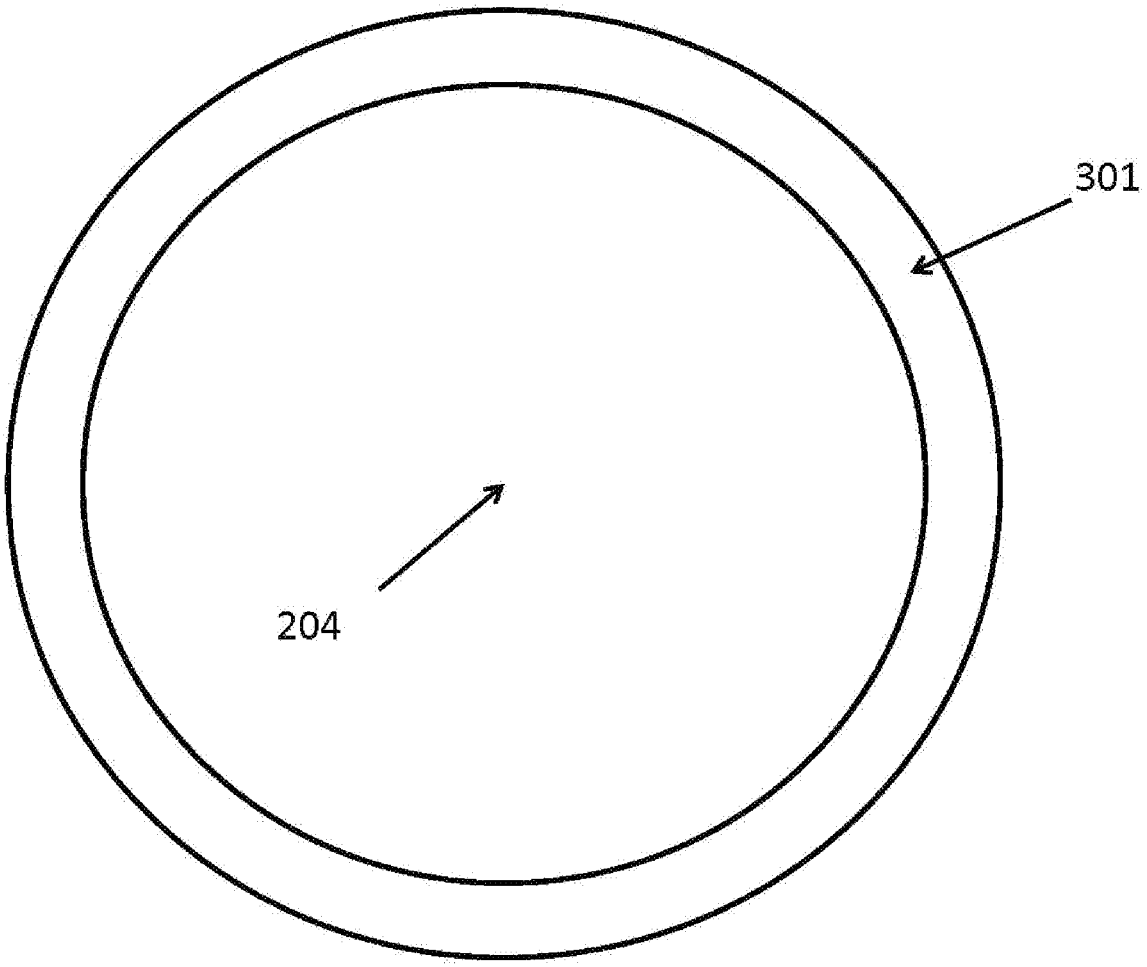
FIG. 3 is a bottom-up view of the bottom of the faucet insulator apparatus.

Referring now to FIGS. 1, 2 and 3, which shows a perspective view of the faucet insulator apparatus 101 with the functional regions annotated. In some embodiments, faucet insulator apparatus 101 comprises capturing recess 201 formed by an insulation region 102. In some embodiments, insulation region 102 comprises is the general insulating component which houses and encircles and encloses a faucet 700 when covered.

Insulation region 102 interacts with the faucet by covering it and shielding it from outdoor elements and freezing conditions. Spatially, insulation region 102 is preferably positioned surrounding the capturing recess 201. Insulation region 102 is preferably shaped like a cylinder.

Insulation region 102 is mainly thought to be composed of polyurethane, however other embodiments may be composed of any of the following: closed cell foam, ethylene-vinyl acetate, polyethylene, polystyrene, fiberglass, foil insulation, mineral wool, cellulose, polyisocyanurate, and natural fibers.

In some embodiments, insulation region 102 has a preferred diameter of 4.125 inches but in some embodiments, may range from a minimum of 3 inches to a maximum diameter of 8 inches. In some embodiments, the diameter of insulation region 102 can be calculated by first determining the size of the faucet insulator apparatus 101 is attached to. In some embodiments, Insulation region 102 preferably comprises circular insulation region 103, base region 105, and finally top region 104. Circular insulation region 103 may be cylindrical in shape.

In some embodiments, circular insulation region 103 is the middle region of the insulation region 102 Q: Which region has the majority of the insulation material (which in turn holds a majority of the insulation material for the faucet). Spatially, circular insulation region 103 is preferably positioned outside the capturing recess 201. In some embodiments, circular insulation region 103 has a preferred thickness of 0.75 inches, but in some embodiments, may range from a minimum of 0.5 inches to a maximum thickness of 1.5 inches.

In some embodiments, circular insulation region 103 has a preferred length of 5 inches, but in some embodiments, may range from a minimum of 4 inches to a maximum length of 8 inches. The circular insulation region 103 is adapted to mediate the insulation of the faucet. In some embodiments, circular insulation region 103 comprises insulation 202 and outside wall 203.

In some embodiments, top region 104 is a secure opening that fits around faucet spout 706 and liquid flow control valve 708. By "fits around" what is meant is that the top region 104 is an opening that is large enough to encircle faucet spout 706 and liquid flow control valve 708. In some embodiments, top region 104 is affixed to faucet 700 adjacent to the outside wall of the dwelling using faucet 700. In some embodiments, base region 105 is a flat area of the insulation region 102 which encloses the faucet insulator apparatus 101 and which ensures that the faucet is protected from cold and other elements. Spatially, base region 105 is preferably positioned below the circular insulation region 103. Base region 105 comprises edge 301 and base 204.

With continued reference to FIG. 2, which shows top-down view of the inside of the faucet insulation apparatus showing the capturing recess for receiving the faucet. In some embodiments, capturing recess 201 is a secure fitting interior region that surrounds and deforms to protect the faucet. Capturing recess 201 interacts with the faucet by deforming to grasp the faucet and adhere to it via gravity and/or friction force.

Spatially, capturing recess 201 is preferably positioned surrounding the faucet and within the insulation region 102. Capturing recess 201 is preferably shaped like a circle however, it is thought that in alternative embodiments that it may also be shaped like square. In some embodiments, capturing recess 201 has a preferred diameter of 2.625 inches but in some embodiments, may range from a minimum of 2 inches to a maximum diameter of 4 inches.

In some embodiments, capturing recess 201 comprises inside wall 501 and inside aperture. Outside wall 203 is the outer surface which encases the insulation 202 in the insulation region 102. Outside wall 203 is preferably shaped like a cylinder however, it is thought that in alternative embodiments that it may also be shaped like square.

Base 204 is the external area that covers the entire end of the insulation region 102. Base 204 is preferably shaped like circle. Base 204 is mainly thought to be composed of polyurethane. In some embodiments, base 204 has a preferred diameter of 4.125 inches but in some embodiments, may range from a minimum of 3 inches to a maximum diameter of 8 inches. One goal of base 204 is to seal the opening for the insulation 202.

Figure 4:
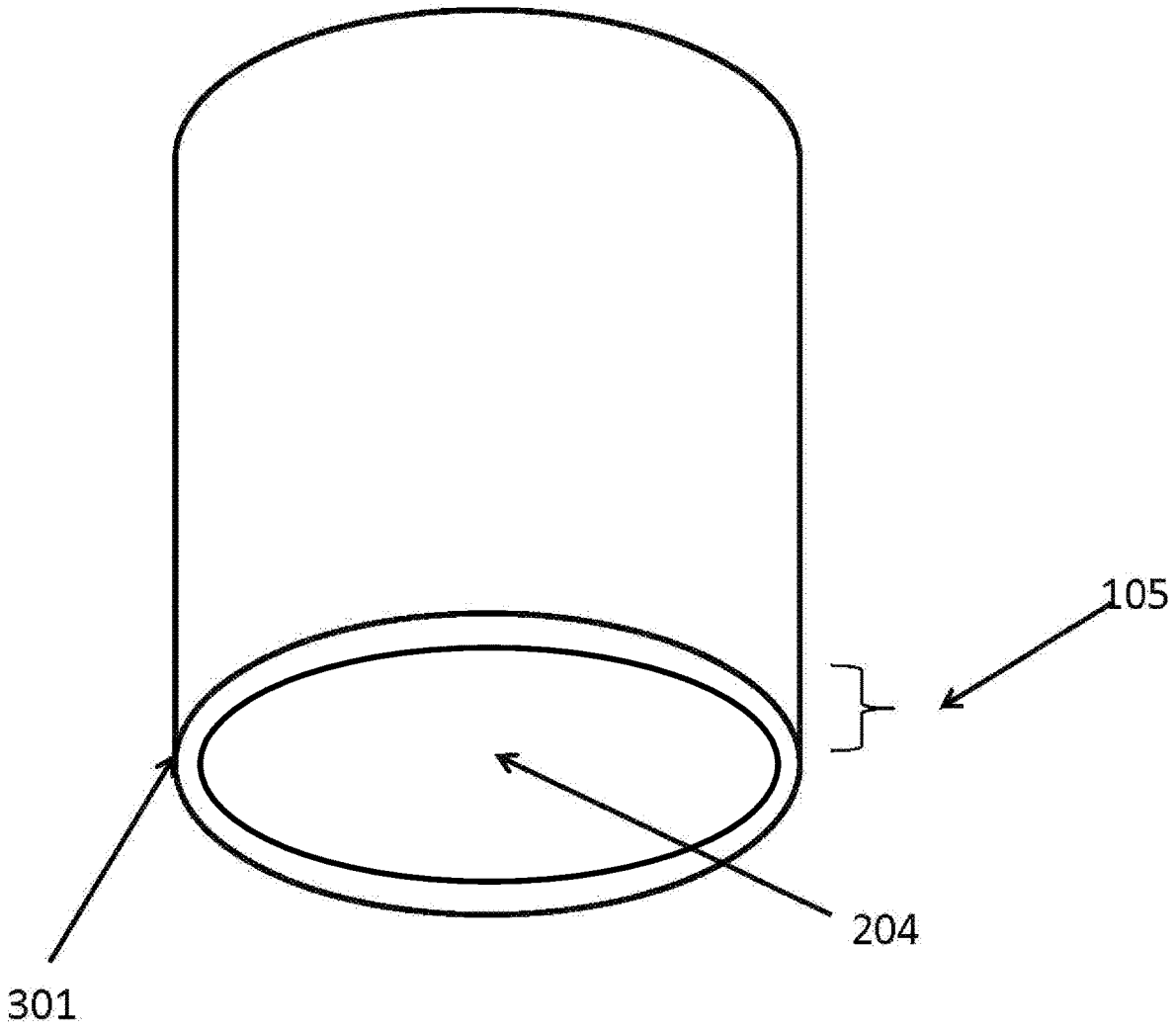
FIG. 4 is a perspective side view of the bottom of the faucet insulator apparatus showing the base region and its subcomponents.
Figure 5:
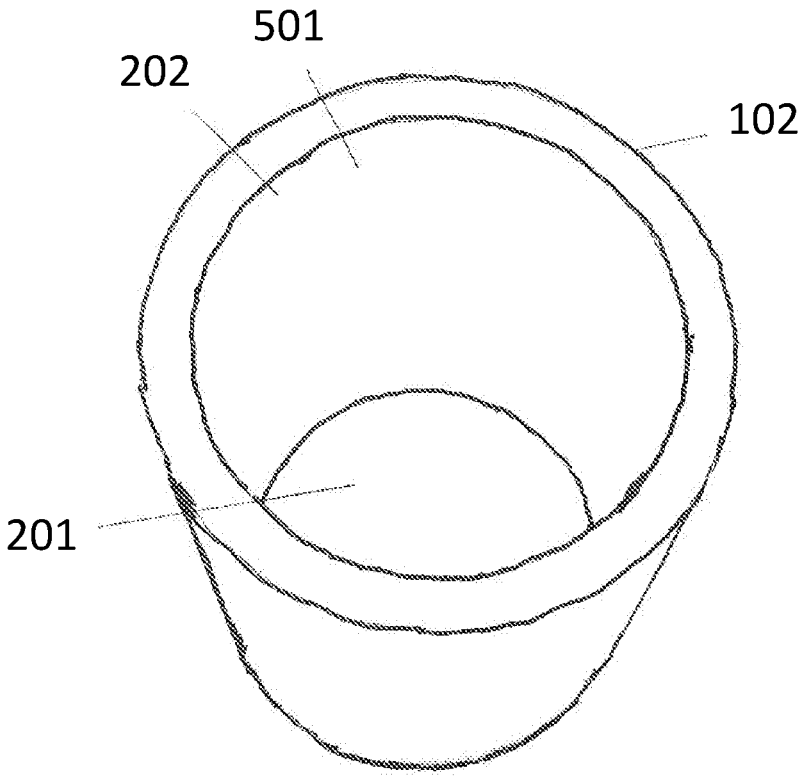
FIG. 5 is a perspective side view of the top of the faucet insulator apparatus showing the capturing recess and its visible related components.

Referring now to FIGS. 3, 4 and 5, which shows I) bottom-up view of the bottom of the faucet insulator apparatus 101, II) a perspective side view of the bottom of the faucet insulator apparatus 101 showing the base region and its subcomponents. III) a perspective side view of the top of the faucet insulator apparatus 101 showing the capturing recess and its visible related components.

Figure 6:
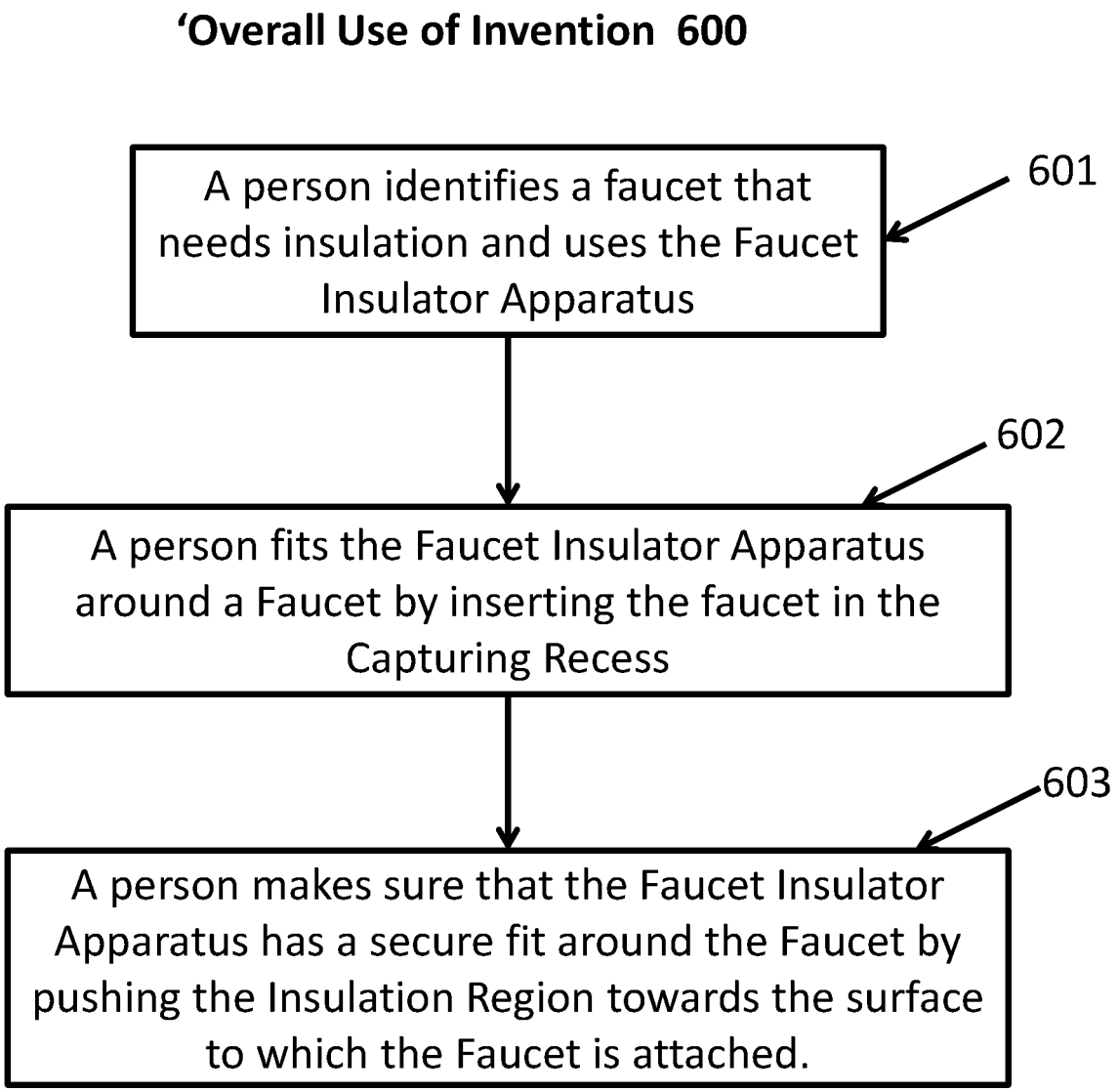
FIG. 6 is a diagram of overall use of the invention.
Figure 7:
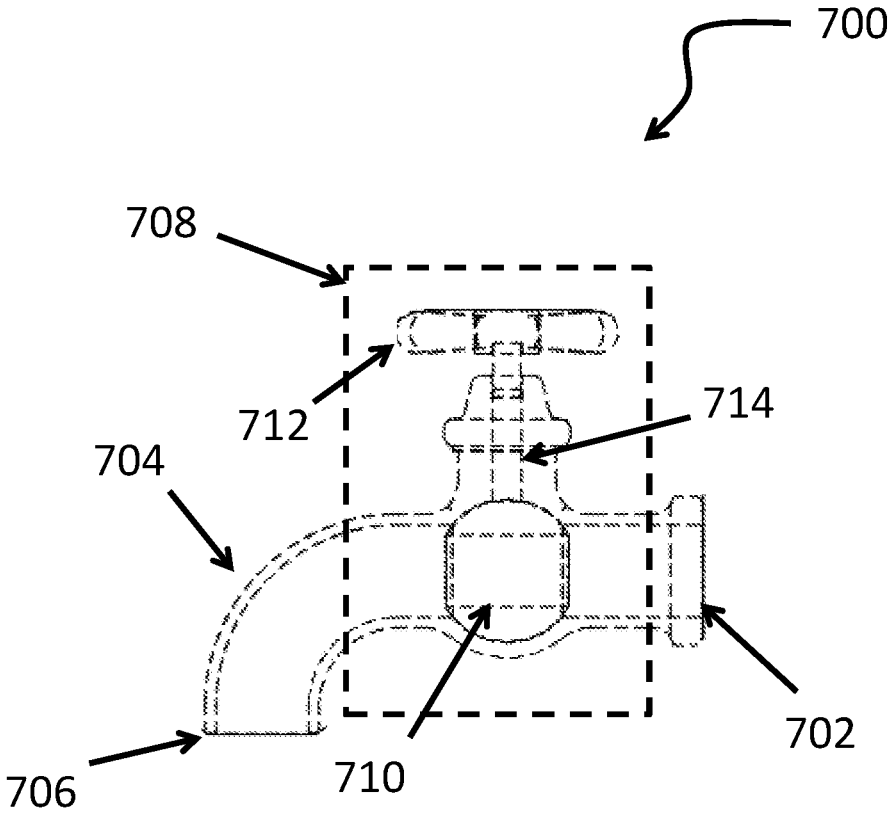
FIG. 7 is a depiction of a prior art faucet.
Figure 8:
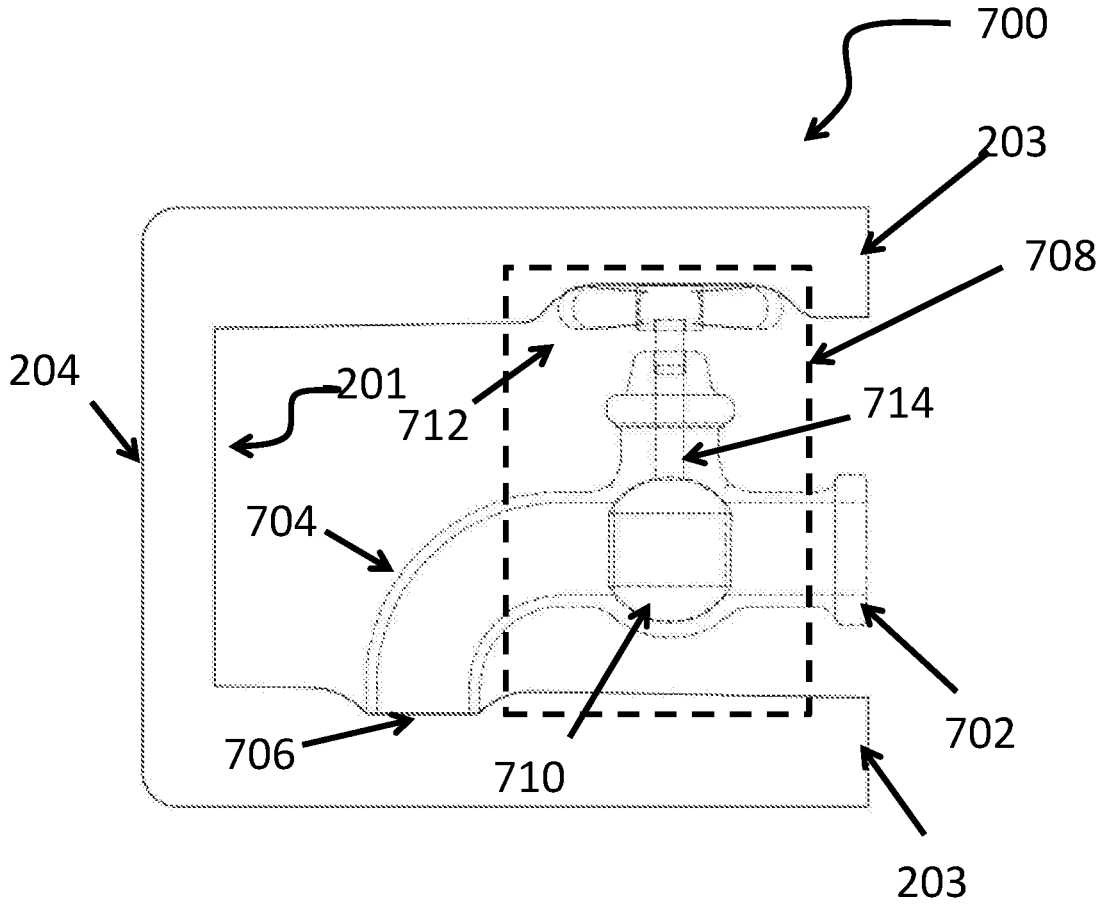
FIG. 8 is an exemplary depiction of the faucet insulator apparatus according to the present invention, protecting a faucet in accordance with the present invention.

Referring now to FIG. 6 and FIG. 8, an ordinary use case of the invention is described. In a first step, a person identifies a faucet 700 that needs insulation. As a result, a user may determine that a faucet insulator apparatus 101 should be used and uses the faucet insulator apparatus 101 (Step 601). Next, a person fits the faucet insulator apparatus 101 around a faucet 700 by inserting faucet 700 inside faucet capturing recess 201 (Step 602). Next, a person makes sure that the faucet insulator apparatus 101 has a secure fit around the faucet 700 by twisting faucet insulator apparatus 101 in a left and right direction relative to faucet spout 706. In this way, the insulation region 102 may be incrementally moved towards the outside wall of the dwelling making use of the faucet 700 (Step 603).

By secure fit, what is meant is that faucet insulator apparatus circular insulation region 103 deforms to the shape to the portion of faucet 700 contacting outside wall 203. Outside wall 203 is removable affixed to faucet 700 inside capturing recess 201. That is, faucet insulator apparatus 101 may be removed from faucet 700 in much the same way that it was installed. Particularly, faucet insulator apparatus 101 may be removed by twisting it in the direction opposite the direction used to install faucet insulator apparatus 101 on faucet 700, as descried above. To further secure the faucet insulator apparatus 101 onto faucet 700, an inner surface of outside wall 203 deforms to the shape of the portion of faucet 700 making contact with outside wall 203. For example, outside wall 203 may include an deformation and grasping region 802 for enveloping (i.e., "tightly engaging") a portion of faucet handle 712. Additionally, insulation region 103 adjacent to an inner surface of outside wall 203 may include a deformation and grasping region 804 for enveloping a portion of the spout 706. Deformation and grasping regions 802 and 804 may be included on an inner surface of outside wall 203. I still another embodiment, deformation and grasping regions 802 and 804 may be positioned adjacent to insulation 202. In still another exemplary embodiment deformation and grasping regions 802 and 804 may be positioned to deform and grasp faucet handle 712 and spout 706, respectively.

By grasping or deforming what is meant is that the regions 802 and 804 forms to the shape of the portion of the faucet 700 in which outside wall 203 comes in contact. For example, where outside wall 203 comes in contact with faucet handle 712, outside wall 203 will deform to the shape of faucet handle 712. By deforming to the shape of faucet handle 712, outside wall 203 may grasp faucet handle 712. Similarly, where outside wall 203 comes in contact with spout 706, outside wall 203 will deform to the shape of portion of the spout 706 contacting outside wall 203. By deforming to the shape of spout 706, outside wall 203 may grasp spout 706. Further still, when deforming and grasping regions 802 and 804 contact the faucet, such as discussed above, then faucet 700 may be secured with faucet insulating apparatus 101.

I claim:

1. A faucet insulation apparatus for insulating a faucet from climate outside a dwelling, wherein the faucet is configured to transport liquid from a first location to a second location, wherein the faucet includes a liquid flow control valve for controlling volume of liquid transported by the faucet, wherein the faucet further includes a spout, the faucet insulation apparatus comprising:

an insulation region, and a capturing recess defined by a tapered inner surface of said insulation region;
wherein said insulation region shape is cylindrical;
wherein said capturing recess shape is tapered;
wherein said insulation region is positioned to surround said capturing recess;
wherein said capturing recess is positioned within said insulation region;
wherein said capturing recess is positioned surrounding said faucet;
wherein said insulation region is adapted to surround and grasp said faucet;
wherein the insulation region is adapted to deform to the faucet as the tapered inner surface advances over the faucet; and
wherein said insulation region adheres to said faucet via gravity and friction.

2. The apparatus of claim 1, wherein said insulation region includes a first deformation and grasping region on said tapered inner surface of said insulation region, the first deformation and grasping region being configured to deform to and grasp the faucet liquid flow control valve.

3. The apparatus of claim 1, wherein said insulation region includes a second deformation and grasping region on said tapered inner surface of said insulation region, wherein the second deformation and grasping region is configured to deform to and grasp the faucet spout.

4. The apparatus of claim 1 wherein said capturing recess has a minimum diameter of 1 inch and a maximum diameter of 4 inches.

5. The apparatus of claim 4 wherein said insulation region has a minimum diameter of 3 inches and a maximum diameter of 8 inches.

6. A faucet insulation apparatus for insulating a faucet from climate outside a dwelling, wherein the faucet is configured to transport liquid from a first location to a second location, wherein the faucet includes a liquid flow control valve for controlling volume of liquid transported by the faucet, wherein the faucet further includes a spout, the faucet insulation apparatus comprising:
an insulation region, and a capturing recess defined by a tapered inner surface of said insulation region,
wherein said insulation region shape is tapered;
wherein said capturing recess shape is tapered;
wherein said insulation region is positioned to surround said capturing recess;
wherein said capturing recess is positioned within said insulation region;
wherein said capturing recess is positioned surrounding said faucet;
wherein said capturing recess is adapted to surround and grasp said faucet;
wherein the insulation region deforms to the faucet as the tapered inner surface advances over the faucet;
wherein said capturing recess has a minimum diameter of 2 inches and a maximum diameter of 4 inches; and
wherein said insulation region has a minimum diameter of 3 inches and a maximum diameter of 8 inches.

7. The apparatus of claim 6, wherein said insulation region includes a first grasping and deformation region, the first grasping region being configured to deform to and grasp the faucet liquid flow control valve.

8. The apparatus of claim 7, wherein said insulation region includes a second grasping and deformation region, wherein the second grasping region is configured to deform to and grasp the faucet spout.

9. The apparatus of claim 6, wherein said insulation region comprises a circular insulation region, a base region, and a top region.

10. The apparatus of claim 6, wherein said insulation region is adapted to mediate the insulating effects on said faucet.

11. The apparatus of claim 6, wherein said insulation region is positioned outside said capturing recess.

12. The apparatus of claim 11 wherein said base region is positioned below said circular insulation region.

13. A faucet insulation apparatus comprising: an insulation region, and a capturing recess defined by a tapered inner surface of said insulation region; wherein said insulation region is adapted to conform to a faucet, wherein the faucet is configured to transport liquid from a first location to a second location, wherein the faucet includes a liquid flow control valve for controlling volume of liquid transported by the faucet, wherein the faucet further includes a spout;
wherein said insulation region shape is cylindrical;
wherein said capturing recess shape is tapered;
wherein said insulation region is positioned to surround said capturing recess;
wherein said capturing recess is positioned within said insulation region;
wherein said capturing recess is positioned surrounding said faucet;
wherein said capturing recess is adapted to surround and grasp said faucet;
wherein the insulation region deforms to the faucet as the tapered inner surface advances over the faucet;
wherein said capturing recess has a minimum diameter of 2 inches and a maximum diameter of 4 inches;
wherein said insulation region has a minimum diameter of 3 inches and a maximum diameter of 8 inches;
wherein said insulation region comprises a circular insulation region, a base region, and a top region;
wherein said circular insulation region is adapted to mediate the insulating effects on said faucet;
wherein said circular insulation region is positioned outside said capturing recess; and
wherein said insulation region includes a first deformation and grasping region on said tapered inner surface of said insulation region, the first deformation and grasping region being configured to deform to and grasp the faucet liquid flow control valve.

14. The apparatus of claim 13, wherein said insulation region includes a second deformation and grasping region formed on the tapered inner surface of the insulation region, wherein the second deformation and grasping region is configured to deform to and grasp the faucet spout.

15. The apparatus of claim 14, wherein said base region is positioned below said circular insulation region.

16. The apparatus of claim 15, wherein said circular insulation region has a minimum length of 4 inches and a maximum length of 8 inches.

17. The apparatus of claim 16, wherein said circular insulation region has a minimum thickness of 0.5 inches and a maximum thickness of 1.5 inches.

18. The apparatus of claim 17, wherein said base region comprises a base, and a base edge.

19. The apparatus of claim 14, wherein said insulation region is made of at least one of foil, insulation, fiberglass, polystyrene, mineral wool, cellulose, polyisocyanurate or natural fibers.

* * * * *